United States Patent [19]

Pearson

[11] 4,367,616

[45] Jan. 11, 1983

[54] WOODEN BEAM SUSPENDED CEILING ASSEMBLY

[76] Inventor: Ronald D. Pearson, 22015 - 146th Ave. East, Graham, Wash. 98338

[21] Appl. No.: 144,177

[22] Filed: Apr. 25, 1980

[51] Int. Cl.[3] ..... E04B 5/52; E04F 19/06

[52] U.S. Cl. ..... 52/664; 52/484; 52/488; 52/665; 52/669; 52/732; 52/777

[58] Field of Search ..... 52/484, 772, 777, 664, 52/665, 488, 669, 732

[56] References Cited

U.S. PATENT DOCUMENTS

| | | | |
|---|---|---|---|
| 2,971,617 | 2/1961 | Smith et al. | 52/484 X |
| 2,994,113 | 8/1961 | Dail | 52/484 |
| 3,013,644 | 12/1961 | Smith et al. | 52/665 X |
| 3,186,037 | 6/1965 | Sklaroff | 52/488 X |
| 3,327,438 | 6/1967 | Cooper | 52/484 X |
| 3,385,020 | 5/1968 | Olson | 52/664 X |
| 3,473,282 | 10/1969 | Robinson, Jr. | 52/488 X |
| 4,281,498 | 8/1981 | Kern | 52/665 X |

FOREIGN PATENT DOCUMENTS

| | | | |
|---|---|---|---|
| 1055793 | 4/1959 | Fed. Rep. of Germany | 52/488 |
| 958859 | 9/1949 | France | 52/488 |

*Primary Examiner*—Alfred C. Perham
*Attorney, Agent, or Firm*—Eugene D. Farley

[57] ABSTRACT

A wooden beam suspended ceiling assembly having a support structure including a wall hanger attachable around the perimeter of the area to receive the ceiling, at least one main beam which extends transversely across the area, and a plurality of cross beams extending between the main beam and wall hanger. The main beam and cross beams provide pockets to receive conventional ceiling panels. The wooden beams in the finished ceiling form an aesthetically attractive ceiling structure especially desirable in residential construction.

13 Claims, 6 Drawing Figures

FIG. 1
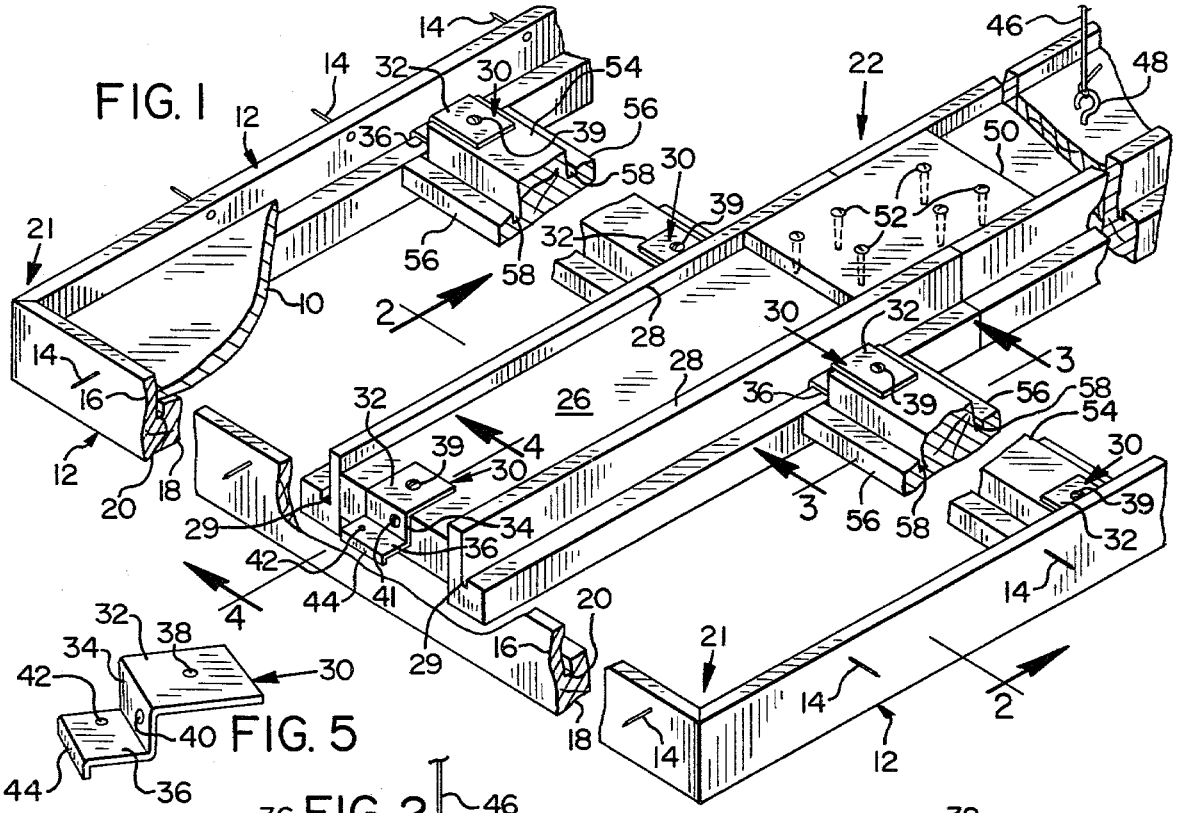
FIG. 5
FIG. 2
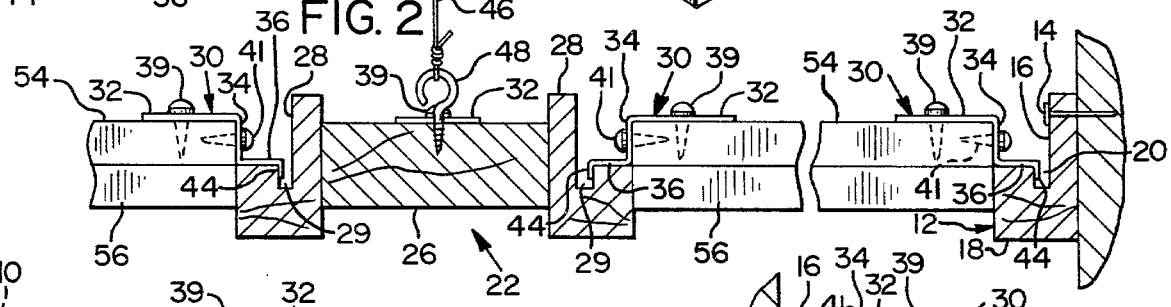
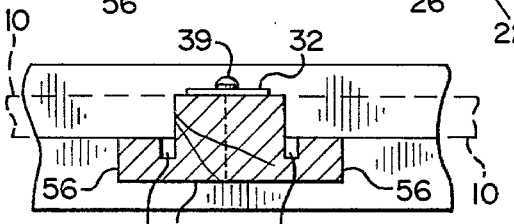
FIG. 3
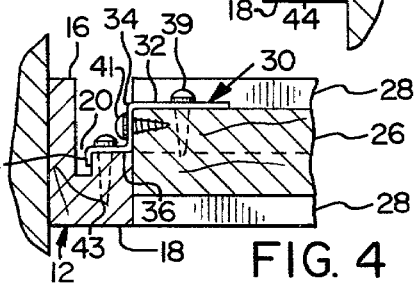
FIG. 4
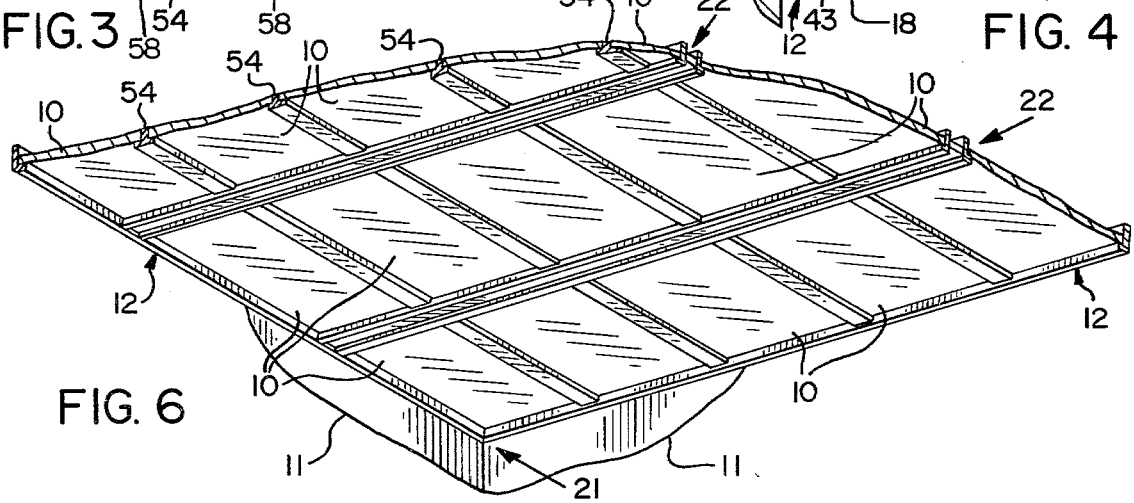
FIG. 6

WOODEN BEAM SUSPENDED CEILING ASSEMBLY

BACKGROUND OF THE INVENTION

This invention relates to suspended ceiling assemblies, and more particularly to a suspended ceiling assembly including a support structure which is made substantially out of wood, thus having the unique aesthetic appeal of a wood-beam ceiling.

Suspended ceiling assemblies of the general class of the present invention are well known in the art. Such prior assemblies are generally constructed of metal, having metal beams, connectors, and a multitude of specialized attachments. While such ceiling assemblies are widely used in office and institutional establishments, a wooden beam ceiling is far more aesthetically appealing for use in residential construction.

Accordingly, it is the general object of the present invention to provide a suspended ceiling assembly which has decorative wooden support members.

It is another object of the present invention to provide a simple ceiling assembly capable of being easily installed by a do-it-yourself carpenter.

Another object is to provide an assembly having relatively few kinds of parts, thus simplifying manufacture and installation.

Yet another object is to provide a wooden beam ceiling support structure which will accommodate commercially available ceiling panels of various styles and sizes.

A further object is to provide a ceiling assembly which is substantially rigid, having more stability than conventional metal systems in the installation phase.

A further object is to provide a versatile ceiling assembly wherein the beams can be easily adjusted to provide for minor unforeseen dimensional variability in the installation, and joints between component support members can be made anywhere.

A further object is to provide ceiling support members which may be easily removed at any time after installation for installing lighting fixtures, making repairs, etc.

A further object is to provide ceiling support members which may be easily extended by butt jointing.

A further object is to provide a sectional ceiling assembly which is easily shipable.

A still further object is to provide a wooden ceiling support assembly where no metal parts are visible in the finished installation.

Yet another object is to provide a beamed ceiling assembly wherein the beams may be finished in various colors or stains.

Other objects and advantages of the present invention will become apparent in the following specification and claims.

BRIEF SUMMARY OF THE INVENTION

In its basic concept, the present invention is a suspended ceiling assembly for supporting a plurality of ceiling panels over a defined area. The support structure for the ceiling panels includes a bracket-like wall hanger extendable around the perimeter of the area to receive the ceiling, at least one main beam extendable transversely across the area, and a plurality of cross beams extendable between the various support members. Each of the main beams and cross beams is supported by a longitudinal extension, or bracket, on each end, adapted to rest on the other support members, thereby supporting the assembly. The support structure defines a plurality of pockets wherein the ceiling panels may be placed.

BRIEF DESCRIPTION OF THE DRAWINGS

FIG. 1 is a fragmentary top perspective view of the suspended ceiling assembly of the present invention, parts being broken away to show the construction thereof.

FIG. 2 is a section taken along the line 2—2 of FIG. 1.

FIG. 3 is a section taken along the line 3—3 of FIG. 1.

FIG. 4 is a section taken along the line 4—4 of FIG. 1.

FIG. 5 is a top perspective view of one of the metal brackets used to interengage the component members of the assembly.

FIG. 6 is a fragmentary bottom perspective view of the finished suspended ceiling assembly.

DETAILED DESCRIPTION OF THE PREFERRED EMBODIMENT

The wooden ceiling assembly of the preferred embodiment of the present invention is shown in finished form in FIG. 6. Illustrated are a plurality of support members, hereinafter discussed in detail, supporting a plurality of ceiling panels 10. The ceiling panels may be acoustical material, translucent for lighting, wooden paneling, or have various other qualities as desired by the installer.

In most cases the perimeter of the area to receive the ceiling is defined by walls as shown at 11. A wall hanger, shown generally at 12, extends around the perimeter of the area and is attached to walls 11 preferably by nails 14 as shown in FIG. 1.

The wall hanger includes a vertical component 16 and a horizontal component 18, as shown in FIGS. 1, 2 and 4. The horizontal component preferably has a recess 20 therein. The vertical component extends sufficiently above the top of the horizontal component to allow convenient nailing of the wall hanger to the wall. However, the wall hanger may be attached by other means such as adhesives, or may be suspended from a structural ceiling overhead (not shown), or supported on posts (not shown) from the floor. At corners the wall hanger is preferably miter jointed as shown at 21.

A main beam, shown generally at 22 in FIGS. 1 and 2, is extendable transversely across the area. The main beam includes a pair of horizontal extensions, one on each side. It is preferably constructed of an elongated beam 26, having a rectangular cross section, faced on each edge by a J-shaped member 28 having a recess 29 therein, similar to wall hanger 12. The J-shaped members may be attached to the rectangular beam by nailing or adhesive means.

The main beam 22 includes on each end a longitudinal extension, preferably comprising a bracket 30, which is adapted to rest on horizontal component 18 of wall hanger 12. The lower surface of the bracket is positioned so that the upper surfaces of the horizontal extensions of the main beam and the horizontal component of the wall hanger will lie in substantially the same plane when the support members are assembled.

Preferably the bracket comprises a first horizontal segment 32, a first vertical segment 34, and a second horizontal segment 36. The first horizontal segment includes a hole 38 and is attachable by screw 39 or other means to the top of rectangular beam 26. The first vertical segment includes a hole 40 and is attachable by screw 41 or other means to the end of the rectangular beam. The second horizontal segment is adapted to rest on the horizontal component of the wall hanger. It includes a hole 42 so that the bracket may be secured by screw 43 or other means to the horizontal component upon which it rests.

The brackets 30 preferably further include a downwardly extending tongue configured to fit into recess 20. This is shown as a second vertical segment 44 attached to the second horizontal segment 36 and extending downwardly therefrom.

During installation, the main beam 22 may be supported at various points along its length by one or more wires 46 extending down from the structural ceiling (not shown) and attached to an eye bolt 48 which is screwed into the main beam.

The main beam 22 may be manufactured in sections, preferably about eight feet in length, and abutted end to end to span the area. To accomplish this, a backing plate 50 is laid over rectangular beam 26, spanning the joint, and glued in place. To further strengthen the bond, a plurality of screws 52 are screwed through the backing plate and into the beam. Care should be taken that the screws do not protrude through the bottom, or face, of the beam.

It should be noted that a plurality of main beams 22 may be employed, as shown in FIG. 6. The main beams are preferably installed parallel to one another at a spaced apart distance, for instance approximately four feet apart, to accommodate standard four foot long panels 10.

A plurality of cross beams 54 extend between main beams 22 and between the outer main beams and wall hanger 12. The cross beams are somewhat similar in cross section to the main beam, having a pair of shouldered lateral extensions 56, one on each side. Preferably the cross beams are manufactured out of one piece, but may be composed of a pair of J-shaped members each having a recess 58 therein similar to the wall hanger, fixed back to back as illustrated by the dashed line in FIG. 3.

The cross beams are connectable in an end to side relationship to the other support members by having a longitudinal extension, preferably comprising a bracket 30, on each end, similar to bracket 30 on the end of the main beam.

Each of the rectangular areas, or pockets, defined by the support members holds a panel 10. The tops of the horizontal extensions of all components lie substantially in the same plane in the finished assembly. The edges of the panels are supported by the horizontal extensions. Lighting, or other fixtures (not shown) may be supported directly by the present ceiling assembly.

OPERATION

The support members 12, 22 and 54, and panels 10 of the present invention are preferably received at the installation site in standard lengths and sizes. The perimeter of the area to receive the ceiling is defined and the desired height of the installed ceiling is established.

Then wall hanger 12 is installed around the perimeter of the area so that the upper surface of its horizontal component 18 is at the predetermined height. The wall hanger can simply be nailed through vertical component 16 which will not allow the heads of nails 14 to be exposed once the installation is finished.

At the corners the wall hanger is preferably miter jointed. If a single standard length of wall hanger is too short to extend along one wall 11, then another section is simply abutted against the end of the first. If it is too long, the sections are sawed to the appropriate length.

Once the wall hanger is in place, main beams 22 are installed. Depending on the width and length of the area, the direction which the main beams are to run is established. If a single section of main beam is too short to span the area, two sections are abutted end to end, and backing plate 50 is applied with adhesive and screws 52. If the beam is too long it may be sawed off to the appropriate length. A metal bracket 30 is then attached to each end of the main beam by screws 39 and 41.

The main beam 22 is then hung and fitted. If it is slightly too long, metal bracket 30 may be removed, the beam trimmed, and the bracket then reapplied.

For intermediate support, eyebolt 48 may be screwed into the top of the beam, and wire 46 extended upwardly therefrom to the structural ceiling. Because of the natural rigidity of the main beam, such supporting connections do not need to be made except in long spans.

Preferably, the first main beam is located centrally through the area, and then other main beams are installed parallel to the first at spaced apart distances. Such a procedure is easy to follow by a do-it-yourself carpenter, and produces a good looking, symmetrically patterned ceiling.

The cross beams 54 are then installed between main beams 22 and between the outer main beams and wall hanger 12. Preferably a procedure similar to that of installation of the main beams is followed.

Cross beams around the perimeter of the area may need to be shortened, and this may be done by sawing a short section off the beam and then replacing metal bracket 30. It is often advantageous to install panels 10 while installing the cross beams, thereby insuring proper spacing of the latter. When the beams are positioned correctly a screw 43 may be used to fix metal bracket 30 at the end of each beam to the horizontal extension upon which it rests.

Either before or after the support members are installed they may be stained, varnished or painted as desired.

If panels 10 are not installed at the same time as cross beams 54, they may be installed thereafter. Panels around the perimeter of the area may need to be trimmed to fit. It should be noted that even after the panels are installed they may be easily interchanged, and if necessary some of the cross beams may be completely removed to allow for installation of oversize panels.

It can be seen from the foregoing description that a suspended ceiling assembly, especially useful in residential construction is provided by the present invention. Because of the inherent nature of wood, a duplication of the structure of prior metal beam ceiling assemblies is not possible. The unique manner of adjusting beam length, and the flexibility of beam positioning makes the present assembly particularly simple and easy to install. In the finished ceiling, no metal parts are exposed, and the wooden beams form an aesthetically pleasing beamed ceiling design.

Having described my invention in its preferred embodiment, I claim:

1. A support structure for supporting a plurality of ceiling panels as a suspended ceiling assembly over an area defined by perimeter walls, the support structure comprising:

(a) an elongated wall hanger attachable to the walls of the defined area and having an upwardly facing horizontal support surface provided with a recess therein terminating above the bottom side of the wall hanger and extending the full length thereof, (b) at least one main beam of substantial rigidity arranged to extend freely between opposite walls inwardly of the wall hanger, the main beam having a cross section including a pair of horizontal extensions, one on each side, each having an upwardly facing horizontal support surface provided with a recess therein terminating above the bottom side of its horizontal extensions and extending the full length thereof, (c) main beam support means comprising longitudinal extensions on the opposite ends of each main beam arranged to rest on the horizontal support surfaces of the wall hanger on opposite walls for supporting the main beam therebetween for removal vertically upward therefrom, each longitudinal extension including a downwardly extending tongue configured to fit in the recess in the wall hanger, (d) a plurality of cross beams each arranged to extend freely between opposed pairs of said horizontal support surfaces, each cross beam having a cross section including a pair of horizontal extensions, one on each side, each having an upwardly facing horizontal support surface, and (e) cross beam support means comprising longitudinal extensions on the opposite ends of each cross beam arranged to rest on opposed pairs of the horizontal support surfaces for supporting the cross beam therebetween for removal vertically upward therefrom, each longitudinal extension including a downwardly extending tongue configured to fit in a recess in the wall hanger or main beam, (f) the main and cross beam support means being arranged to dispose the horizontal support surfaces of the wall hanger and main and cross beams in a common plane to form an upwardly facing support for the edges of ceiling panels.

2. The support structure of claim 1 wherein the main beam comprises a first member having a rectangular cross section, and a pair of second members secured to the opposite sides of the first member and each having a J-shape cross section defining a first vertical component secured to the first member, a second vertical component of shorter height than the first vertical component and forming said upwardly facing horizontal support surface, and an intermediate component of shorter height than the second vertical component and forming said recess.

3. The support structure of claim 1 wherein the wall hanger is J-shape in cross section defining a first vertical component arranged for attachment to the walls of the defined area, a second vertical component of shorter height than the first vertical component and forming said upwardly facing horizontal support surface, and an intermediate component of shorter height than the second vertical component and forming said recess.

4. The support structure of claim 1 wherein the main beam comprises a first member having a rectangular cross section, and a pair of second members secured to the opposite sides of the first member and each having a J-shape cross section defining a first vertical component secured to the first member, a second vertical component of shorter height than the first vertical component and forming said upwardly facing horizontal support surface, and an intermediate component of shorter height than the second vertical component and forming said recess, and the wall hanger is J-shape in cross section defining a first vertical component arranged for attachment to the walls of the defined area, a second vertical component of shorter height than the first vertical component and forming said upwardly facing horizontal support surface, and an intermediate component of shorter height than the second vertical component and forming said recess.

5. A support structure for supporting a plurality of ceiling panels as a suspended ceiling assembly over an area defined by perimeter walls, the support structure comprising:

(a) an elongated wall hanger attachable to the walls of the defined area and having an upwardly facing horizontal support surface, (b) at least one main beam of substantial rigidity arranged to extend freely between opposite walls inwardly of the wall hanger, the main beam having a cross section including a pair of horizontal extensions, one on each side, each having an upwardly facing horizontal support surface, (c) main beam support means comprising longitudinal extensions on the opposite ends of each main beam arranged to rest on the horizontal support surfaces of the wall hanger on opposite walls for supporting the main beam therebetween for removal vertically upward therefrom, the longitudinal extension on each end of each main beam comprising a metal bracket having a first horizontal segment attachable to the top of the main beam, a first vertical segment extending downwardly from the first horizontal segment and attachable to the end of the beam, and a second horizontal segment extending from the first vertical segment and adapted to rest on the horizontal support surface of the wall hanger, (d) a plurality of cross beams each arranged to extend freely between opposed pairs of said horizontal support surfaces, each cross beam having a cross section including a pair of horizontal extensions, one on each side, each having an upwardly facing horizontal support surface, and (e) cross beam support means on the opposite pairs of the horizontal support surfaces for supporting the cross beam therebetween for removal vertically upward therefrom (f) the main and cross beam support means being arranged to dispose the horizontal support surfaces of the wall hanger and cross beam in a common plane to form an upwardly facing support for the edges of ceiling panels.

6. The support structure of claim 5 wherein the horizontal support surface of the wall hanger has a recess therein and the metal bracket further includes a second vertical segment extending downwardly from the second horizontal segment and configured to fit in said recess.

7. A support structure for supporting a plurality of ceiling panels as a suspended ceiling assembly over an area defined by perimeter walls, the support comprising:

(a) an elongated wall hanger attachable to the walls of the defined area and having an upwardly facing horizontal support surface, (b) at least one main beam of substantial rigidity arranged to extend freely between opposite walls inwardly of the wall hanger, the main beam having a cross section including a pair of horizontal extensions, one on each side, each having an upwardly facing horizontal support surface, (c) main beam support means on the opposite ends of each main beam arranged to engage the horizontal support surfaces of the wall hanger on opposite walls for supporting the main beam therebetween for removal vertically upward therefrom, (d) a plurality of cross beams each arranged to extend freely between opposed pairs of said horizontal support surfaces, each cross beam having a cross section including a pair of horizontal extensions, one on each side, each having an upwardly facing horizontal support surface, and (e) cross beam support means comprising longitudinal extensions on the opposite ends of each cross beam arranged to rest on opposed pairs of the horizontal support surfaces for supporting the cross beam therebetween for removal vertically upward therefrom, the longitudinal extension on each end of each cross beam comprising a metal bracket having a first horizontal segment attachable to the top of the cross beam, a first vertical segment extending downwardly from the first horizontal segment and attachable to the end of the beam, and a second horizontal segment extending from the first vertical segment and adapted to rest on the horizontal support surfaces of the wall hanger and the main beam horizontal extensions, (f) the main and cross beam support means being arranged to dispose the horizontal support surfaces of the wall hanger and main and cross beam in a common plane to form an upwardly facing support for the edges of ceiling panels.

8. The support structure of claim 7 wherein the horizontal support surface of the wall hanger has a recess therein and the metal bracket further includes a second vertical segment extending downwardly from the second horizontal segment and configured to fit in said recess.

9. A support structure for supporting a plurality of ceiling panels as a suspended ceiling assembly over an area defined by perimeter walls, the support structure comprising:

(a) an elongated wall hanger attachable to the walls of the defined area and having an upwardly facing horizontal support surface, (b) at least one main beam of substantial rigidity arranged to extend freely between opposite walls inwardly of the wall hanger, the main beam having a cross section including a pair of horizontal extensions, one on each side, each having an upwardly facing horizontal support surface, (c) main beam support means on the opposite ends of each main beam arranged to engage the horizontal support surfaces of the wall hanger on opposite walls for supporting the main beam therebetween for removal vertically upward therefrom, (d) a plurality of cross beams each arranged to extend freely between opposed pairs of said horizontal support surfaces, each cross beam having a cross section including a pair of horizontal extensions, one on each side, each having an upwardly facing horizontal support surface, (e) cross beam support means on the opposite ends of each cross beam arranged to engage opposed pairs of the horizontal support surfaces for supporting the cross beam therebetween for removal vertically upward therefrom, (f) the main and cross beam support means comprising longitudinal extensions on the opposite ends of each beam, each longitudinal extension comprising a metal bracket having a first horizontal segment attachable to the top of the beam, a first vertical segment extending downwardly from the first horizontal segment and attachable to the end of the beam, and a second horizontal segment extending from the first vertical segment and adapted to rest on the horizontal support of the wall hanger and main beam horizontal extensions, (g) the main and cross beam support means being arranged to dispose the horizontal support surfaces of the wall hanger and main and cross beams in a common plane to form an upwardly facing support for the edges of ceiling panels.

10. The support structure of claim 9 wherein the metal brackets for the main and cross beams have the same dimensions.

11. A support structure for supporting a plurality of ceiling panels as a suspended ceiling assembly over an area defined by perimeter walls, the support structure comprising:

(a) an elongated wall hanger attachable to the walls of the defined area and having an upwardly facing horizontal support surface, (b) at least one main beam of substantial rigidity arranged to extend freely between opposite walls inwardly of the wall hanger, the main beam having a cross section including a pair of horizontal extensions, one on each side, each having an upwardly facing horizontal support surface, (c) a metal main beam support bracket on each of the opposite ends of each main beam, each bracket having a first horizontal segment attachable to the top of the main beam, a first vertical segment extending downwardly from the first horizontal segment and attachable to the end of the beam, and a second horizontal segment extending from the first vertical segment and adapted to rest on the horizontal support surface of the wall hanger (d) a plurality of cross beams each arranged to extend freely between opposed pairs of said horizontal support surfaces, each cross beam having a cross section including a pair of horizontal extensions, one on each side, each having an upwardly facing horizontal support surface, (e) a metal cross beam support bracket on each of the opposite ends of each cross beam, each bracket having a first horizontal segment attachable to the top of the cross beam, a first vertical segment extending downwardly from the first horizontal segment and attachable to the end of the beam, and a second horizontal segment extending from the first vertical segment and adapted to rest on the horizontal support surface of the wall hanger and main beam horizontal extensions, the main and cross beam support brackets being arranged to dispose the horizontal support surfaces of the wall hanger and main and cross beams in a common plane to form an upwardly facing support for the edges of ceiling panels.

12. The support structure of claim 11 wherein the horizontal support surfaces of the wall hanger and main beam horizontal extensions have a recess therein and each metal support bracket further includes a second vertical segment extending downwardly from the second horizontal segment and configured to fit in said recess.

13. The support structure of claim 12 wherein the metal brackets for the main and cross beams have the same dimensions.

* * * * *